US010722937B2

(12) United States Patent
Fernandez Orive et al.

(10) Patent No.: US 10,722,937 B2
(45) Date of Patent: Jul. 28, 2020

(54) SAND CORE MAKING MACHINE METHOD

(71) Applicant: Loramendi, S. Coop., Vitoria-Gasteiz (ES)

(72) Inventors: Luis Alfonso Fernandez Orive, Vitoria-Gasteiz (ES); Alberto Ortiz de Elguea Gastiain, Vitoria-Gasteiz (ES)

(73) Assignee: LORAMENDI, S. COOP., Vitoria-Gasteiz (ES)

( * ) Notice: Subject to any disclaimer, the term of this patent is extended or adjusted under 35 U.S.C. 154(b) by 0 days.

(21) Appl. No.: 16/420,319

(22) Filed: May 23, 2019

(65) Prior Publication Data

US 2019/0275581 A1 Sep. 12, 2019

Related U.S. Application Data

(63) Continuation of application No. PCT/ES2017/070801, filed on Dec. 7, 2017.

(30) Foreign Application Priority Data

Dec. 20, 2016 (EP) ..... 16382625

(51) Int. Cl.
*B22C 1/16* (2006.01)
*B22C 9/12* (2006.01)

(52) U.S. Cl.
CPC ..... *B22C 1/162* (2013.01); *B22C 1/16* (2013.01); *B22C 9/12* (2013.01); *B22C 9/123* (2013.01)

(58) Field of Classification Search
CPC .. B22C 1/162; B22C 1/16; B22C 9/12; B22C 9/123
See application file for complete search history.

(56) References Cited

U.S. PATENT DOCUMENTS

2003/0173049 A1 9/2003 Herreid et al.
2007/0246182 A1 10/2007 Bovens
(Continued)

FOREIGN PATENT DOCUMENTS

EP 1815924 A1 8/2007
EP 1849537 A1 10/2007
(Continued)

OTHER PUBLICATIONS

International Search Report and Written Opinion in corresponding International Application No. PCT/ES2017/070801, dated Mar. 15, 2018, 13 pages.
(Continued)

*Primary Examiner* — Kevin P Kerns
*Assistant Examiner* — Steven S Ha
(74) *Attorney, Agent, or Firm* — Edell, Shapiro & Finnan, LLC

(57) ABSTRACT

Apparatus and methods for making a sand core in a core box are provided. According to one embodiment, the method includes introducing into a cavity of the core box a sand-binder mixture, the sand-binder mixture being introduced into the cavity through an inlet conduit of the core box. Pressurized air is then introduced into the cavity while a flow rate of the pressurized air is measured in a first air flow path upstream the core box. A control unit automatically alters the degree of opening of an electronically controlled flow regulator located in a second air flow path located downstream an outlet conduit of the core box depending on the measured flow rate to regulate the flow of pressurized air into the cavity of the core box.

17 Claims, 1 Drawing Sheet

(56) References Cited

U.S. PATENT DOCUMENTS

| | | | |
|---|---|---|---|
| 2009/0236070 | A1 | 9/2009 | Ide et al. |
| 2016/0250680 | A1 | 9/2016 | Polzin et al. |

FOREIGN PATENT DOCUMENTS

| | | | |
|---|---|---|---|
| EP | 3338911 | A1 | 6/2018 |
| JP | 2009090334 | A | 4/2009 |

OTHER PUBLICATIONS

Extended European Search Report in corresponding EP Application No. 16382625.8, dated Jul. 19, 2017, 8 pages.

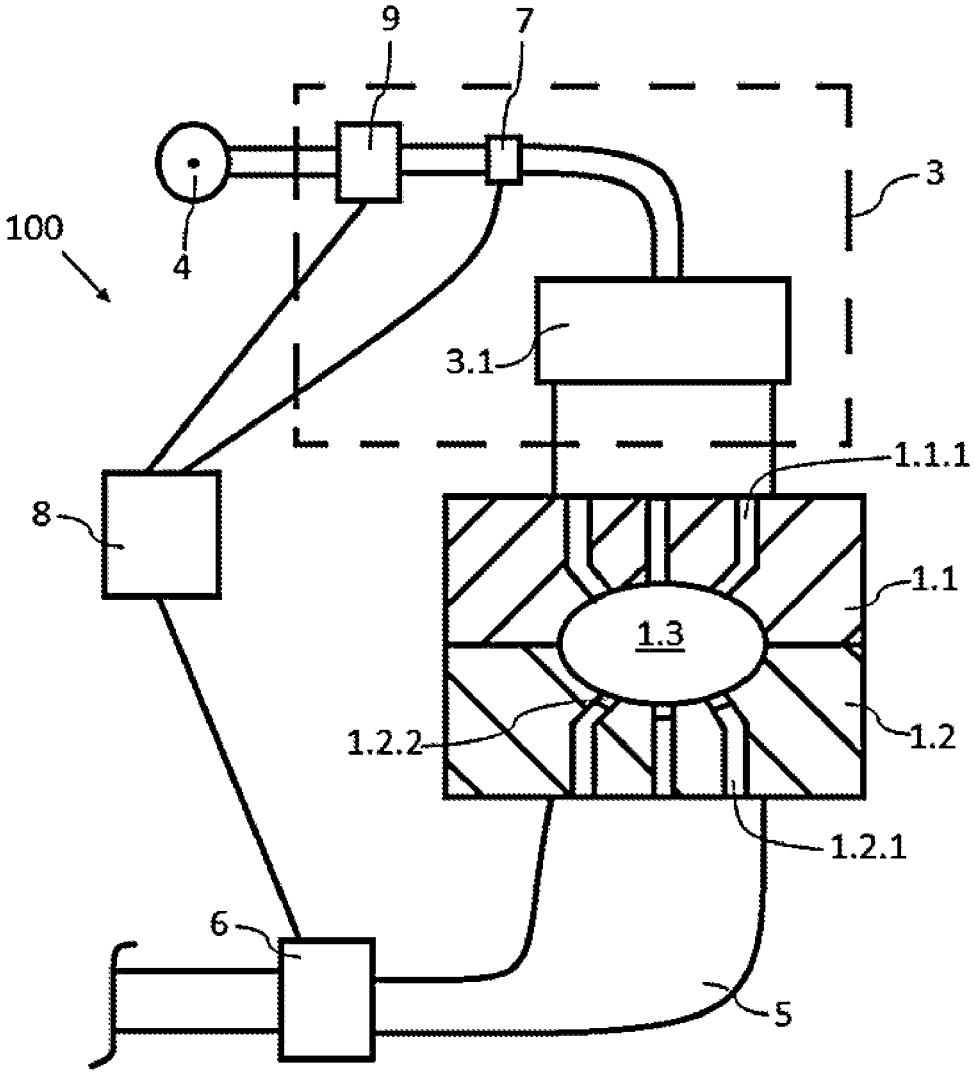
9
7
3
100
4
3.1
1.1.1
8
1.1
1.3
1.2.2
1.2
1.2.1
6
5

SAND CORE MAKING MACHINE METHOD

CROSS-REFERENCE TO RELATED APPLICATIONS

This application relates to and claims the benefit and priority to International Application No. PCT/ES2017/070801, filed Dec. 7, 2017, which relates to and claims the benefit and priority to European Application No. EP16382625.8, filed Dec. 20, 2016.

TECHNICAL FIELD

The present invention relates to sand core making machines and methods.

BACKGROUND

In sand core making machines, the cores are made from a mixture containing sand and a binder. The mixture is introduced in a core box defining a cavity (or cavities) with the shape of the core (or cores) to be made. The core box is usually made up of two facing forming implements, defining the cavity therebetween. A single core can be made in one and the same core box (a cavity is defined), or a plurality of cores can be made simultaneously (a plurality of cavities is defined).

Each cavity defined in a core box is filled with the mixture used for making the core. Before introducing said mixture in the corresponding cavity, said cavity is full of air that must be discharged to allow said mixture to be housed in said cavity. To that end, the core box comprises at least one outlet conduit communicating the cavity with the outside of the core box, through which said air is discharged to the outside (to the environment) as said mixture is gradually being introduced. A filter is furthermore arranged in the outlet conduit to prevent said mixture from being discharged therethrough. Said outlet conduit is usually a through hole of the lower implement.

Once the required mixture is in the corresponding cavity, said mixture is hardened to provide rigidity to the core such that it can then be used where and as required.

The binder used may be organic or inorganic. For hardening mixtures with organic binders, a catalyst such as amine, for example, is usually applied on the mixture, and in some cases pressurized hot air can be used (usually together with the catalyst). Due to the properties of the binder or the catalyst, contaminant gases are generated during mixture hardening and a subsequent treatment or process on said gases is required. Furthermore, due mainly to the cost and danger of catalysts of this type, said catalysts are supplied in a controlled and metered manner, requiring a more complex and costly control over the catalysts compared to the control required over air (when air is used).

For hardening mixtures with inorganic binders, it is usually sufficient to apply pressurized hot air on the mixture drying said mixture by absorbing at least part of its moisture, hardening it, without contaminant gases being generated during the process (moist air is usually generated as a result of moisture absorption).

In hardening processes using pressurized hot air, the air used is dry and hot so that it absorbs moisture from the mixture present in the cavity, such that said mixture is hardened. In addition to this, it is common to heat the core box so that the actual heat of said core box also absorbs part of the moisture of the mixture. The air is generally supplied from a pressurized air source and conducted to the core box, passing it beforehand through a heating device for heating it, such that it reaches said core box (and therefore the corresponding cavity) hot. Since it is hot, it is able to absorb moisture from the mixture present in the core box, and the higher the temperature the air has as it enters the core box, the higher the absorption capacity it will have. However, the more the values of these properties of the air increase, the higher the cost that will be entailed in the core making process (particularly due to the energy requirements necessary for achieving high temperatures).

In processes of this type, there is furthermore a need to assure a minimum air pressure at the air inlet in the core box to assure that said air reaches the entire mixture present in the cavity. If the air reaches it at a low pressure, there is a risk of it not reaching the center of said mixture, for example, with the risk this entails in making fragile cores (the center is not hardened in this case), and/or of it not reaching all the cores suitably (if a plurality of cores is made simultaneously in one and the same core box). Therefore, pressure regulators are usually arranged between the pressurized air source and the heating device to assure that the air is supplied at least with the required minimum pressure. When replacing one core box with another, air pressure can be regulated to a new desired value, if required, given that each of the core boxes can have different needs, and this regulated pressure is maintained as long as the core box is not changed, not being modified during a core making cycle.

The pressurized hot air which is introduced in the core box for hardening the mixture present therein must be discharged as it is introduced so that the moisture of the mixture is discharged from the core box and said mixture is properly hardened. The outlet conduit (generally a plurality of outlet conduits) of the core box through which air present in the corresponding cavity is discharged as the mixture is introduced therein is normally utilized for this discharge, said pressurized and already moist hot air thereby being discharged from the core box through said outlet conduit.

Finally, the core thus made is removed from the core box, and the core box is ready to start another making cycle.

Patent document EP1849537A1 discloses a sand core making machine, comprising a core box in which an inorganic mixture which is subsequently hardened with pressurized hot air is introduced. The machine comprises a heating device between the source and the core box, and a proportional pressure valve arranged between said source and said heating device for regulating air pressure. To improve hardening process efficiency, this machine comprises two alternative air paths from the source to the core box which are selected in a controlled manner depending on the moment of said process. The air is first passed through a heating unit of the heating device with a specific heating capacity, and the air is then passed through said heating unit and two other additional heating units of said heating device arranged in series with the first, thereby significantly increasing air temperature and therefore air moisture absorption capacity. This, however, requires a high overall energy consumption, despite the fact that energy only needs to be provided to one heating unit in the first phase, and furthermore requires a complex installation given that there is a need to provide two different air paths, which makes maintenance difficult and increases the cost thereof.

US20160250680A1 discloses a method for producing cores or molded parts, in which a basic molding material is mixed with alkali silicate or water binder and a lost core or a molded part is formed using a core shooter in a core box.

US20030173049A1 discloses a sand core making machine comprising a core box, a blowing device suitable for introducing a sand-containing mixture in the core box, and a hardening device suitable for introducing pressurized hot-air in the core box, conducted through a specific path, for hardening the mixture present in said core box.

SUMMARY

A first aspect relates to a sand core making machine comprising a core box in which the core is formed, a blowing device suitable for introducing the material used for generating the core in the core box, and a hardening device suitable for introducing pressurized hot air in the core box for hardening the material introduced earlier in said core box. The machine further comprises a specific pressurized air path from a pressurized air source to the core box, and at least one heating unit arranged in said path, such that the pressurized air goes through same before reaching the core box. The heating unit is thus arranged upstream of the core box for heating the pressurized air before it reaches said core box. The heating unit is part of the hardening device. The material used for generating the core is a sand-binder mixture which is hardened by means of pressurized hot air.

The machine comprises a flowmeter for measuring the flow of pressurized air through the pressurized air path to the core box, which is preferably arranged in said path upstream of the heating unit, and a flow regulator with which said flow can be regulated depending on said measurement.

The machine further comprises a control unit which is communicated with the flowmeter and with the flow regulator, and configured for acting on the flow regulator for regulating pressurized airflow depending on the measurement obtained by means of the flowmeter.

The core box comprises a cavity with the shape of the core to be made, at least one inlet conduit communicating the outside of the core box with the cavity, to be able to introduce the mixture and the pressurized air in the cavity, and at least one outlet conduit, different from the inlet conduit, communicating the outside of the core box with the cavity to be able to discharge air present in the cavity from said cavity as the mixture and the pressurized air are introduced in said cavity. The machine comprises an outlet pipe fluidically communicated with the outlet conduit for conducting air discharged through said outlet conduit where required, and the flow regulator is arranged in said outlet pipe, said flow regulator thereby being configured for directly regulating the flow through the outlet pipe. Therefore, by means of regulating the flow regulator arranged in said outlet pipe, the airflow delivered to the core box is also regulated.

In this manner, a control over the flow entering the core box which influences the moisture absorption capacity of said pressurized air can be achieved, which allows using the optimal flow estimated for the corresponding core box, hardening process efficiency and therefore core making efficiency being improved in a simple and cost-effective manner. In principle, a higher absorption capacity is obtained with a larger flow, but it is possible that moisture absorption cannot be improved after a given flow, and in this case excess flow would be heated, which would have a negative influence.

In particular, a heating unit of the kind used in machines of this type is suitable for heating pressurized air passing therethrough depending on the flow, given that its heating capacity depends on the amount of pressurized air which is in contact with it and on the duration of said contact, such that having direct control over the pressurized airflow going through a heating unit can also mean having direct control over the temperature of the pressurized air after it passes through said heating device, control over another relevant absorption capacity-related property of the pressurized air thereby also being able to be obtained. A desired commitment between pressurized air temperature and flow for hardening the material present in the corresponding core box can thus be obtained, hardening process efficiency (and therefore core making efficiency) being further improved both in time and cost (because excessive heating of the pressurized air, or otherwise, increasing the hardening cycle time, is prevented) in a simple and cost-effective manner.

Furthermore, this allows regulating pressurized airflow during one and the same hardening cycle and/or while using the same core box, said flow thus being able to be optimized at each moment (in real time), but this also allows modifying said flow to adjust it to that desired for different core boxes. Each core box can be different depending on the core(s) to be made with it, which can entail different needs or properties of the pressurized hot air for hardening the material present therein, because both the amount and the form of said mixture can vary in different core boxes, and these conditions can furthermore be obtained beforehand such that they are known when the hardening cycle is performed and said flow can be regulated taking into account said information. A relevant property can thus be directly controlled when hardening the cores, hardening efficiency of the material present in the relevant core box being able to be improved, and therefore core making efficiency can be improved in a simple and cost-effective manner.

Additionally, efficiency can be improved with this machine without requiring any intervention for regulating the pressure of the pressurized air such that it can be adjusted to needs at the beginning and can be kept as such, if required, without this negatively affecting efficiency. Improved efficiency is thereby obtained with the proposed machine, while at the same time assuring at all times that, under normal operating conditions, the pressure of the pressurized air is sufficient for hardening the entire core when it reaches the core box.

A second aspect relates to a sand core making method.

In the method, in order to make a core a sand-binder mixture is introduced in a cavity of a core box through at least one inlet conduit of the core box, said mixture being the material used for making said cores, and after introducing said mixture in the core box, pressurized hot air is introduced in said core box for hardening said mixture through said inlet conduit, conducting said pressurized air to the core box through a specific path.

During the introduction of pressurized hot air in the core box, pressurized airflow going through the path through which said pressurized air is conducted to the core box is measured, and depending on said measurement, said flow is regulated to a specific flow value to improve mixture hardening efficiency. Flow measurement and regulation are performed automatically, and the pressurized air introduced in the core box being conducted to where it is required through an outlet pipe after being discharged from the core box through an outlet conduit that fluidically communicates the cavity with the outlet pipe. The passage through said outlet pipe is regulated to regulate the flow of pressurized air through the path conducting it to the core box, a flow regulator arranged in the outlet pipe being acted on for regulating the pressurized airflow, the degree of opening/closing of said flow regulator being regulated to regulate flow. The advantages thus obtained with the method are the same as those mentioned with respect to the first aspect.

These and other advantages and features will become evident in view of the drawings and the detailed description.

BRIEF DESCRIPTION OF THE DRAWINGS

FIG. 1 shows a schematic depiction of a sand core making machine according to one embodiment.

DETAILED DESCRIPTION

A first aspect relates to a sand core making machine 100 comprising a core box 1 in which at least one core is formed. The core box 1 defines a cavity 1.3 with the shape of the core to be made. The core box is preferably formed by at least one upper implement 1.1 and one lower implement 1.2 demarcating the cavity 1.3 therebetween.

The machine 100 comprises a blowing device (not depicted in the drawings) for introducing a material used for making the core in the core box 1, particularly in the cavity 1.3 defined in the core box 1. Said material comprises a sand-binder mixture. The machine 100 is preferably configured for making sand cores with inorganic processes, such that said mixture comprises an inorganic binder and contaminant gases are not generated during core making.

The core box 1 comprises at least one through inlet forming an inlet conduit 1.1.1 and extending from the outside of the core box 1 to the cavity 1.3, through which said mixture is introduced in the cavity 1.3. The core box 1 preferably comprises a plurality of inlet conduits 1.1.1, and the inlet conduits 1.1.1 are arranged in the upper implement 1.1. Before introducing said mixture in the cavity 1.3, said cavity is full of air that must be discharged to allow said mixture to be housed in said cavity 1.3. To that end, the core box 1 comprises at least one through outlet forming an outlet conduit 1.2.1 and extending from the cavity 1.3 to the outside of the core box 1, through which said air is discharged from the cavity 1.3 as said mixture is being gradually introduced in said cavity 1.3. A filter 1.2.2 is furthermore arranged in the outlet conduit 1.2.1 to prevent said mixture from being discharged therethrough. The core box 1 preferably comprises a plurality of outlet conduits 1.2.1. In the embodiment shown in the drawings, all the outlet conduits 1.2.1 have been depicted in the lower implement 1.2 of the core box 1, but the upper implement 1.1 may also comprise outlet conduits 1.2.1.

The machine 100 further comprises a hardening device 3 suitable for introducing pressurized hot air in the core box 1 for hardening the mixture present in said core box 1 once the required amount of mixture has been introduced in said core box 1. The machine 100 comprises a path for said pressurized air to the core box 1, which can be part of the hardening device 3. The hardening device 3 comprises at least one heating unit 3.1 in said path, upstream of the core box 1, for heating the pressurized air before it reaches said core box 1, said path being configured so that said pressurized air goes through the heating unit 3.1 (or at least through a site in which said air is heated by said heating unit 3.1). The hardening device 3 is furthermore suitable for being connected to an air source 4, preferably to a pressurized air source 4, through which the air used for hardening the mixture present in the core box 1 is supplied. The introduced pressurized air must be discharged from the core box 1 once it absorbs the moisture from the mixture as it passes through said core box 1, and the outlet conduit 1.2.1 of the core box 1 is used to that end.

The machine 100 further comprises a flowmeter 7 for measuring the flow of pressurized air through said path, preferably in real time, said flowmeter 7 is preferably furthermore arranged upstream of the heating unit 3.1, and a flow regulator 6 arranged such that it is configured to be able to regulate said flow depending on said measurement. Therefore, in order to improve hardening process efficiency, and therefore core making efficiency, the machine 100 is configured to be able to have control over the pressurized airflow going through the path through which said pressurized air is delivered to the core box 1, in an easy, simple and cost-effective manner. The flow regulator 6 is preferably an electronically-controlled proportional flow valve, but it may also be a manually-controlled proportional flow valve. In this last case, users themselves regulate airflow by manually acting on the flow regulator 6, depending on the identified measurement of the flowmeter 7. The machine 100 can further comprise a pressure regulator 9 for regulating the pressure at which the air is conducted to the core box 1, which can be, for example, an electrically-controlled proportional pressure valve (although it could also be manually controlled).

In some embodiments, the machine 100 can have a display, for example, to be able to display the measured flow, a user being responsible for acting on the flow regulator 6 for regulating the flow depending on the identified measurement, as described. However, to make this method easier, in other embodiments the machine 100 is configured for performing these tasks automatically. To that end, said machine 100 comprises a control unit 8 which is communicated with the flowmeter 7 for receiving the measurement taken by said flowmeter 7 and with the flow regulator 6 in order to be able to act thereon. The control unit 8 is configured for acting on the flow regulator 6 depending on the measurement obtained by means of the flowmeter 7 to thereby regulate pressurized airflow, as required. The control unit 8 can be any device with data processing and/or computing capacity, such as a microprocessor or a microcontroller, for example. In this case, the flow regulator 6 could be an electronically-controlled valve, preferably an electronically-controlled proportional flow valve. If the machine 100 comprises a pressure regulator 9, the control unit 8 can also be communicated with said pressure regulator 9 for controlling same.

The machine 100 can further comprise a memory (not depicted in the drawings) with flow-related information. The optimal flow value (or values) for the specific core box 1 (or for a plurality of core boxes 1, the target core box 1 being selected in each case) can be stored beforehand in the memory, such that the control unit 8 compares the value measured by the flowmeter 7 with this stored value and acts on the flow regulator 6 for modifying the flow, when appropriate, depending on the result of said comparison. This example of the operation of the memory is non-limiting and other possibilities could be used, such as uploading the information of each core box 1 when the corresponding core box 1 is arranged or will be arranged in the machine 100, for example. The memory may or may not be integrated in the control unit 8 itself.

The core box 1 comprises at least one inlet conduit 1.1.1 communicating the outside of the core box 1 with the cavity 1.3, thereby allowing the entry therethrough of pressurized air to the cavity 1.3. The inlet conduit 1.1.1 is preferably arranged in the upper implement 1.1. The core box 1 preferably comprises a plurality of inlet conduits 1.1.1.

In a preferred embodiment, the machine 100 comprises an outlet pipe 5 in fluid communication with the outlet conduit 1.2.1 for conducting air leaving the core box 1 through said outlet conduit 1.2.1 to where it is required. The flow regulator 6 is preferably arranged in said outlet pipe 5, said flow regulator 6 thereby being configured for directly regulating the airflow going through the outlet pipe 5. The outlet pipe 5 is in fluid communication with the path comprised in the machine 100 for conducting pressurized air to the core box 1 through the core box 1 itself (particularly through the outlet conduit 1.2.1, the cavity 1.3 and the inlet conduit 1.1.1), such that when regulating the airflow through said outlet pipe 5, the airflow through said path is also indirectly regulated. Therefore, by means of regulating the flow regulator 6 arranged in said outlet pipe 5, the airflow delivered to the core box 1 is also regulated, the temperature of said air also being able to be easily controlled in addition to the flow, as described above. If the core box 1 comprises a plurality of outlet conduits 1.2.1, the outlet pipe 5 comprises a conduit per each outlet conduit 1.2.1 and a main conduit in which the flow regulator 6 is arranged connected to the different conduits, although preferably the outlet pipe 5 comprises a single conduit connected with all the outlet conduits 1.2.1.

The outlet pipe 5 is coupled to the core box 1 through a specific coupling which allows quick and simple coupling and uncoupling. In this manner, when one core box 1 is to be replaced with another, for example, the outlet pipe 5 can be uncoupled from the core box 1 comprised in the machine 100 at that moment, and subsequently coupled to the new core box 1 of said machine 100.

The inclusion of an outlet pipe 5 and a flow regulator 6 in said outlet pipe 5 furthermore allows obtaining another series of advantages in the machine 100, in addition to those already described. With this configuration of the machine 100, the control unit 8 can furthermore be configured for identifying an anomaly in the machine 100 during the introduction of pressurized air in the core box 1, depending on the measurement obtained by means of the flowmeter 7 and depending on the degree of opening of the flow regulator 6.

For example, the control unit 8 can be configured for detecting an obstruction in the outlet conduit 1.2.1 depending on how much the flow regulator 6 is regulating the flow (degree of opening/closing of said flow regulator 6) and on the measurement obtained with the flowmeter 7, and for identifying said obstruction, which is at least a partial obstruction, as an anomaly, if the measured flow value is less than a specific minimum threshold value for the corresponding degree of opening/closing of the flow regulator 6. If in order to attain the required flow there is a need to cause a degree of opening/closing in the flow regulator 6 greater than a specific degree, the control unit 8 is capable of identifying this inconsistency and identifying it as an anomaly, furthermore being able to report same. This can be due, for example, to the fact that the outlet conduit 1.2.1 has been completely or partially obstructed by the mixture from the cavity 1.3, and this can thus be reported so that a user acts as they deem necessary (stopping the machine 100 and cleaning the corresponding through inlet or replacing the core box 1, for example) and where appropriate, such that the user only interrupts production when it is actually required. The values at which the control unit 8 can identify an anomaly are previously established in the corresponding operating cycle, and can be stored in the memory described above or in an additional memory. The control unit 8 can also be configured for stopping the machine 100 when it identifies this anomaly.

The control unit 8 can also be configured for detecting an unwanted pressurized air leak in the core box 1 depending on how much the flow regulator 6 is regulating the flow (degree of opening/closing of said flow regulator 6) and on the measurement obtained with the flowmeter 7, and for identifying said leak as an anomaly if the measured flow value is greater than a specific maximum threshold value for the corresponding degree of opening/closing of the flow regulator 6. For example, if an incoherent flow (a high flow) is measured despite the flow being completely or partially closed with the flow regulator 6, this can be a sign that there is a leak through which the pressurized air flows out (and not only through the outlet pipe 5). The control unit 8 can therefore report this anomaly, and the user will act as they deem appropriate. Anomalies negatively affecting core making efficiency can therefore be detected (in this case, excess pressurized air and excess heat output would go to waste), which contributes to improving overall machine efficiency. The control unit 8 can also be configured for stopping the machine 100 when it identifies this anomaly.

The control unit 8 can be configured for detecting the two cases described above, an obstruction and an air leak, as described, respectively.

Therefore, further as a result of the additional capacity for detecting anomalies in the machine 100, like in the case described above, for example, a safer machine 100 is obtained.

In cases in which the machine 100 comprises an outlet pipe 5 and a flow regulator 6 arranged in said outlet pipe 5, the control unit 8 can furthermore be configured for maintaining the highest possible flow through the outlet pipe 5 during the introduction of the mixture in the core box 1, and for regulating said flow by adapting the degree of opening/closing of the flow regulator 6 depending on the measurement thereof during the introduction of pressurized air in the core box 1. Therefore, when blowing the mixture in the core box 1 the air present in said core box 1 is allowed to leave said core box 1 as quick as possible to obtain a process that is as quick as possible, whereas when hardening said mixture present in the core box 1 the maximum flow through the outlet pipe 5 is regulated to obtain more efficient hardening. In this manner, incorporating an outlet pipe 5 and a flow regulator 6 arranged in said outlet pipe 5 for improving hardening efficiency does not negatively affect the blowing process during core making, and therefore does not negatively affect the production of cores in the corresponding machine 100, despite the fact that the air discharged from the core box 1 during blowing and the pressurized air discharged from said core box 1 during hardening share the same discharge path (the outlet conduit 1.2.1 and the outlet pipe 5).

A second aspect relates to a sand core making method in which, in order to make a core, a corresponding sand-binder mixture is introduced in a core box 1 in which cores are made, said mixture being the material used for making said cores, and after introducing said mixture in the core box 1, pressurized hot air is introduced in said core box 1 for hardening said mixture, said pressurized air being conducted to the core box 1 through a specific path. The method is preferably a sand core making method in which, in order to make core, an inorganic sand-binder mixture is introduced, contaminant gases not being generated during core making.

During the introduction of pressurized hot air in the core box 1, the flow of pressurized air through the path through which it is conducted to the core box 1 is measured, and depending on said measurement, said flow is regulated to a desired flow value, the same advantages as those described above for the machine 100 being obtained. Flow measurement and regulation are preferably performed automatically, there being to that end, for example, a control unit 8, a flowmeter 7 and a flow regulator 6 communicated to one another, as described for the first aspect of the invention.

The pressurized air introduced in the core box 1 is conducted to where it is required through an outlet pipe 5 after being discharged from the core box 1 through the outlet conduit 1.2.1, the passage through said outlet pipe 5 being regulated to regulate the flow of pressurized air through the path conducting it to the core box 1. This is possible because said path and said outlet pipe 5 are in fluid communication through the core box 1, as described for the first aspect of the invention, such that regulation in one location also has impact on another location. To regulate the flow of pressurized air, a flow regulator 6 arranged in the outlet pipe 5 is acted on, the degree of opening of said flow regulator 6 being regulated to regulate the maximum flow allowed through the outlet pipe 5.

During the introduction of the mixture in the core box 1, the flow of pressurized air through the outlet pipe 5 is maintained at the highest possible flow regardless of the flow measurement, flow regulation being performed depending on said measurement during the introduction of pressurized air in the core box 1. Therefore, as described above for the machine 100, the process of blowing material in the core box 100 is not negatively affected by the inclusion of the outlet pipe 5 and the pressure regulator 6 for improving hardening process efficiency, despite the fact that the air discharged from the core box 1 during blowing and the pressurized air discharged from said core box 1 during hardening share the same discharge path (the outlet pipe 5).

The proposed method can be implemented in a machine 100 such as the one of the first aspect in any of the embodiments and/or configurations of the machine 100. Similarly, the proposed machine 100 is suitable and/or configured for supporting the method of the second aspect in any of the embodiments and/or configurations of the method.

The following clauses disclose in an unlimited manner additional embodiments.

Clause 1. A sand core making machine comprising a core box (1), a blowing device suitable for introducing a sand-binder mixture in the core box (1), and a hardening device (3) suitable for introducing pressurized hot air in the core box (1), conducted through a specific path to said core box (1), for hardening the mixture present in said core box (1), the hardening device (3) comprising at least one heating unit (3.1) in said path upstream of the core box (1) for heating said pressurized air before it reaches said core box (1), and the machine (100) further comprising a flowmeter (7) for measuring the flow of the pressurized air through said path and a flow regulator (6) for regulating said airflow, the flow regulator (6) being able to be acted on depending on the measurement obtained by the flowmeter (7), the machine (100) further comprises a control unit (8) which is communicated with the flowmeter (7) and with the flow regulator (6), and configured for acting on the flow regulator (6) for regulating pressurized airflow depending on the measurement obtained by means of the flowmeter (7), the core box (1) comprising a cavity (1.3) with the shape of the core to be made, at least one inlet conduit (1.1.1) communicating the outside of the core box (1) with the cavity (1.3) to be able to introduce the mixture and the pressurized air in the cavity (1.3), and at least one outlet conduit (1.2.1) different from the inlet conduit (1.1.1), communicating the outside of the core box (1) with the cavity (1.3) to be able to discharge air present in the cavity (1.3) from said cavity (1.3) as the mixture and the pressurized air are introduced in said cavity (1.3), the machine (100) comprising an outlet pipe (5) in fluid communication with the outlet conduit (1.2.1) for conducting air discharged through said outlet conduit (1.2.1) where required, and the flow regulator (6) being arranged in said outlet pipe (5), said flow regulator (6) thereby being configured for directly regulating the flow through the outlet pipe (5).

Clause 2: The sand core making machine according to clause 1, wherein the control unit (8) is configured for identifying an anomaly in the machine (100) during the introduction of pressurized air in the core box (1), depending on the flow measurement obtained by means of the flowmeter (7) and depending on how much the flow regulator (6) is regulating the flow through the outlet pipe (5), said control unit (8) being configured for detecting at least a partial obstruction of the outlet conduit (1.2.1) depending on the flow measurement obtained by means of the flowmeter (7) and depending on how much the flow regulator (6) is regulating the flow of pressurized air through the path to the core box (1), and for identifying said obstruction as an anomaly if the measured flow value is less than a specific minimum threshold value for the corresponding flow regulated by the flow regulator (6), and/or being configured for detecting an unwanted pressurized air leak in the core box (1) depending on the flow measurement obtained by means of the flowmeter (7) and depending on how much the flow regulator (6) is regulating the flow of pressurized air through the path, and for identifying said leak as an anomaly if the measured flow value is greater than a specific maximum threshold value for the corresponding flow regulated by the flow regulator (6).

Clause 3: The sand core making machine according to clause 1 or 2, wherein the control unit (8) is configured for maintaining the highest possible flow through the outlet pipe (5) during the introduction of the mixture in the core box (1), and for regulating said flow by adapting how much the flow regulator (6) is regulating the flow depending on the measurement of the flowmeter (7) during the introduction of pressurized air in the core box (1).

Clause 4: The sand core making machine according to any of the preceding clauses, wherein the flow regulator (6) is an electronically-controlled proportional flow valve.

Clause 5: A sand core making method, wherein to make a core a sand-binder mixture is introduced in a cavity (103) of a core box (1) through at least one inlet conduit (1.1.1) of the core box (1), after introducing said mixture in the core box (1), pressurized hot air is introduced in said core box (1) for hardening said mixture through said inlet conduit (1.1.1), conducting said pressurized air to the core box (1) through a specific path, and, during the introduction of pressurized hot air in the core box (1), the flow of pressurized air through said path is measured, and, depending on said measurement, said flow is regulated to a desired flow value, characterized in that flow measurement and regulation is performed automatically, the pressurized air introduced in the core box (1) being conducted to where it is required through an outlet pipe (5) and an outlet conduit (1.2.1) that fluidically communicates the cavity (1.3) with the outlet pipe (5), after being discharged from the core box (1), the passage through said outlet pipe (5) being regulated to regulate the flow of pressurized air through the path conducting it to the core box (1), a flow regulator (6) arranged in the outlet pipe (5) being acted on for regulating the pressurized airflow, the degree of opening/closing of said flow regulator (6) being regulated to regulate flow.

Clause 6: The sand core making method according to clause 5, wherein anomalies are detected during the introduction of pressurized air in the core box (1) depending on the obtained flow measurement and depending on how much the flow regulator (6) is regulating the flow through the outlet pipe (5), at least a partial obstruction being detected as an anomaly if the measured flow value is less than a specific minimum threshold value for the corresponding flow regulated by the flow regulator (6), and/or an unwanted pressurized air leak in the core box (1) being detected as an anomaly if the measured flow value is greater than a specific maximum threshold value for the corresponding flow regulated by the flow regulator (6).

Clause 7: The sand core making method according to clause 5 or 6, wherein during the introduction of the mixture in the core box (1), the flow of pressurized air through the outlet pipe (5) is maintained at the highest possible flow regardless of the flow measurement, flow regulation being performed depending on said measurement during the introduction of pressurized air in the core box (1).

What is claimed is:

1. A sand core making apparatus comprising:

a core box having a cavity in which the sand core is formed, the core box including an inlet conduit and an outlet conduit, the outlet conduit being in fluid communication with the inlet conduit through the cavity;

a blowing device configured to deliver a sand-binder mixture into the cavity of the core box through the inlet conduit of the core box;

a hardening apparatus configured to introduce pressurized air into the cavity of the core box through the inlet conduit of the core box, the hardening apparatus including a heating unit located in a first air flow path upstream of the inlet conduit of the core box, the heating unit configured to heat the pressurized air before the pressurized air is introduced into the inlet conduit of the core box;

a flowmeter configured to measure a flow of the pressurized air in the first air flow path;

a second air flow path in fluid communication with the outlet conduit of the core box through which the pressurized air is discharged out of the core box;

an electronically operated flow regulator located in the second air flow path, the electronically operated flow regulator configured to directly regulate the flow of the pressurized air passing through the second air flow path and to indirectly regulate the flow of the pressurized air passing through the first air flow path; and a control unit that is configured to receive input signals from the flowmeter indicative of flow values of the pressurized air passing through the flowmeter, the control unit being configured to act on the electronically operated flow regulator to regulate the flow of the pressurized air in the second air flow path depending on the input signals received from the flowmeter.

2. The sand core making apparatus according to claim 1, wherein the electronically operated flow regulator is an electronically controlled proportional flow valve that produces a flow output proportional to an electronic control input from the control unit.

3. The sand core making machine according to claim 2, wherein the control unit is configured to detect an obstruction in the outlet conduit of the core box by comparing a flow value received from the flowmeter with the degree of opening of the electronically controlled flow valve and determining an existence of the obstruction if the flow value received from the flowmeter is less than a specific minimum threshold value for the corresponding degree of opening of the electronically controlled valve.

4. The sand core making machine according to claim 2, wherein the control unit is configured to detect an air leak in the core box by comparing a flow value received from the flowmeter with the degree of opening of the electronically controlled flow valve and determining an existence of the air leak if the flow value received from the flowmeter is greater than a specific maximum threshold value for the corresponding degree of opening of the electronically controlled valve.

5. The sand core making apparatus according to claim 1, wherein the electronically operated flow regulator is an electronically controlled flow valve in which a degree of opening of the electronically controlled flow valve is alterable to produce variable pressurized air flow rates inside the second air flow path in response to electronic control inputs from the control unit.

6. The sand core making apparatus according to claim 5, wherein the control unit comprises a processor and a memory having stored therein one or more optimal flow values associated with the core box, the control unit configured to compare the flow values obtained from the flowmeter with the one or more optimal values stored in the memory and to alter the control input to the electronically controlled flow valve based on the comparison.

7. The sand core making apparatus according to claim 1, wherein the flowmeter is located upstream of the heating unit in the first air flow path.

8. The sand core making apparatus according to claim 1, wherein the second air flow path is defined by an outlet pipe to which the electronically operated flow regulator is attached, the core box being removably coupled to the outlet pipe.

9. The sand core making apparatus according to claim 1, wherein the core box includes first and second outlet conduits that are respectively in fluid communication with first and second outlet pipes located downstream of the first and second outlet conduits, the sand core making apparatus further including a third outlet pipe located downstream of the first and second outlet pipes and in fluid communication with the first and second outlet pipes, the electronically operated flow regulator being located in the third outlet pipe.

10. A method for making a sand core in a core box, the core box having a cavity in which the sand core is formed, an inlet conduit and an outlet conduit, the outlet conduit being in fluid communication with the inlet conduit through the cavity, the method comprising;

introducing into the cavity of the core box a sand-binder mixture, the sand-binder mixture being introduced into the cavity through the inlet conduit of the core box;

introducing pressurized air into the cavity through the inlet conduit of the core box;

measuring a flow rate of the pressurized air in a first air flow path upstream of the inlet conduit of the core box; and through use of a control unit, automatically altering the degree of opening of an electronically controlled flow regulator located in a second air flow path located downstream of the outlet conduit of the core box depending on the measured flow rate to regulate the flow of pressurized air into the cavity of the core box.

11. The method of making a sand core in a core box according to claim 10, further comprising heating the pressurized air prior to introducing the pressurized air into the inlet conduit of the core box.

12. The method of making a sand core in a core box according to claim 10, wherein a flowmeter is used in the measuring of the flow rate of the pressurized air in the first air flow path.

13. The method of making a sand core in a core box according to claim 10, wherein the electronically operated flow regulator is an electronically controlled proportional flow valve that produces a flow output proportional to an electronic control input from the control unit.

14. The method of making a sand core in a core box according to claim 10, wherein the electronically operated flow regulator is an electronically controlled flow valve in which a degree of opening of the electronically controlled flow valve is alterable to produce variable pressurized air flow rates inside the second air flow path in response to electronic control inputs from the control unit.

15. The method of making a sand core in a core box according to claim 10, further comprising detecting an obstruction in the outlet conduit of the core box by comparing the measured flow rate of the pressurized air in a first air flow path with the degree of opening of the electronically controlled flow valve and determining an existence of the obstruction if the flow rate is less than a specific minimum threshold value for the corresponding degree of opening of the electronically controlled valve.

16. The method of making a sand core in a core box according to claim 10, further comprising detecting an air leak in the core box by comparing the measured flow rate of the pressurized air in the first air flow path with the degree of opening of the electronically controlled flow valve and identifying the leak as an anomaly if the measured flow rate of the pressurized gas is greater than a specific maximum threshold value for the corresponding degree of opening of the electronically controlled valve.

17. The method of making a sand core in a core box according to claim 10, wherein during when the sand-binder mixture is introduced into the core box the electronically operated flow regulator is maintained in a maximum open position without regard to the measured flow rate of the pressurized air in the first air flow path.

* * * * *